US005986610A

United States Patent [19]

Miron

[11] Patent Number: 5,986,610

[45] Date of Patent: Nov. 16, 1999

[54] VOLUME-LOADED SHORT DIPOLE ANTENNA

[76] Inventor: Douglas B. Miron, 221-17th Ave., Brookings, S. Dak. 57006

[21] Appl. No.: 09/097,431

[22] Filed: Jun. 15, 1998

Related U.S. Application Data

[63] Continuation-in-part of application No. 08/852,044, May 6, 1997, abandoned, which is a continuation of application No. 08/540,973, Oct. 11, 1995, abandoned.

[51] Int. Cl.[6] ..... H01Q 1/24; H01Q 9/28

[52] U.S. Cl. ..... 343/702; 343/752; 343/802; 343/807; 343/898

[58] Field of Search ..... 343/702, 802, 343/807, 809, 752, 795, 896–898, 828–831; H01Q 1/24, 9/16, 9/28

[56] References Cited

U.S. PATENT DOCUMENTS

| | | | |
|---|---|---|---|
| 2,503,952 | 4/1950 | Laport | 343/807 |
| 2,615,005 | 10/1952 | White | 343/802 |
| 2,642,528 | 6/1953 | Albright | 343/802 |
| 2,673,931 | 3/1954 | Stevens | 343/802 |
| 2,942,259 | 6/1960 | Green | 343/807 |
| 3,434,145 | 3/1969 | Wells | 343/807 |
| 3,656,167 | 4/1972 | Lea | 343/802 |
| 3,732,572 | 5/1973 | Kuo | 343/802 |
| 3,739,388 | 6/1973 | Callaghan | 343/726 |
| 3,821,742 | 6/1974 | Pollard | 343/727 |
| 4,183,027 | 1/1980 | Ehrenspeck | 343/726 |
| 4,426,649 | 1/1984 | Dubost et al. | 343/700 MS |
| 4,584,586 | 4/1986 | Kosci | 343/742 |
| 4,809,009 | 2/1989 | Grimes et al. | 343/726 |

(List continued on next page.)

FOREIGN PATENT DOCUMENTS

| | | | |
|---|---|---|---|
| 4315542 | 4/1965 | Japan | 343/752 |

OTHER PUBLICATIONS

Jensen et al, "Performance Analysis of Antennas for Hand–Held Transceivers Using FDTD", IEE Trans. on Antennas and Prop., vol. 42, No. 8, Aug. 1994.

Friedman, "Wide–Band Matching of a Small Disk–Loaded Monopole," IEEE Trans. on Antennas & Prop., vol. AP–33, No. 10, Oct. 1985.

Hansen, Fundamental Limitations in Antennas, Proc. IEEE, vol. 69, No. 2, Feb. 1981.

Chu, "Physical Limitations of Omni–Directional Antennas," J. Applied Physics, vol. 19, Dec. 1948.

Singer et al, "Broadband Antenna for Field–Intensity Meters", Electronics, Feb. 1956, pp. 130, 131.

(List continued on next page.)

*Primary Examiner*—Michael C. Wimer

*Attorney, Agent, or Firm*—Kaardal & Associates, PC

[57] ABSTRACT

An electric dipole antenna includes a first and a second arm extending along a dipole axis away from a feed gap in substantially opposite directions. A first and a second end body are operatively coupled to opposite ends of the first and the second arms. Each end body has a width dimension which extends perpendicular to the dipole axis. A dipole length dimension extends along the dipole axis through the first and the second arms and the first and the second end bodies. A current conduction circuit provides a radiation field for the electric dipole antenna. The circuit passes along the first and the second arms and around a closed perimeter of the first and the second end bodies. As a result, the electric dipole antenna exhibits a series resonant frequency at a wavelength which is at least eight times the dipole length dimension. In addition, an electric monopole antenna design is used. The monopole is situated over a conducting ground plane which reflects the above-ground plane portion of the antenna. With the reflection portion, the monopole antenna effectively forms a dipole antenna that has the same characteristics of the electric dipole design described above.

19 Claims, 5 Drawing Sheets

OTHER PUBLICATIONS

Mautz et al, "Radiation & Scattering from Bodies of Revolution", Applied Science Research vol. 20, Jun. 1969.

Simpson et al., "Equivallent Circuits for Electrically Small Antennas Using LS Decomposition with the Method of Moments". IEEE Trans. On Antennas & Prop., vol. 37, No. 12, Dec. 1989.

Ogawa et al. "A Diversity Antenna for Very Small 800MHz Band Portable Telephones", IEEE Trans. on Antennas and Prop., vol. 42, No. 8, Aug. 1994.

Miron, "The Short Fat Dipole—Development in APL of a MOM Solution", South Dakota State University, Brookings, S.D.Apr. 1995.

- PRIOR ART -

VOLUME-LOADED SHORT DIPOLE ANTENNA

CROSS REFERENCE TO RELATED APPLICATION

This application is a continuation-in-part of my prior utility patent application Ser. No. 08/852,044, filed May 6, 1997 which is a continuation of utility patent applicant Ser. No. 08/540,973 filed Oct. 11, 1995, both abandoned.

FIELD OF THE INVENTION

The present invention relates generally to antenna designs. More particularly, the present invention relates to dipole antenna designs having end bodies with a width dimension comparable to a dipole length dimension.

BACKGROUND OF THE INVENTION

Antennas for transmission of radio signals are generally designed to match impedance as closely as possible with a transmitter so that the transmitter power output is maximized. Any difference in the impedance results in less than 100% of the potential transmitter power being transferred to and radiated by an antenna coupled to the transmitter. In contrast, antennas for reception of radio signals are generally designed to have an electric dipole series resonant frequency at or near the center of a frequency band which is to be received by a particular antenna.

At the series resonant frequency, energy is transferred from the antenna to the receiver circuit input at a maximum rate (e.g., without excessive loss). An excessive loss in this transfer occurs when there is an impedance mismatch between the antenna and the receiver circuit. Using a frequency other than the resonant frequency results in a less efficient power transfer, because the impedance mismatch between the antenna and input increases as the received frequency diverges from the resonant frequency. By "tuning" a receiving antenna to have a resonant frequency centered in the frequency band to be received, a close matching of the impedance between receiving antenna and a receiver circuit input is achieved.

At the desired resonant frequency, prior art antennas are often implemented under the constraint that the electric dipole length of a radiator must be approximately equal to half of the wavelength of a radio signal. For portable radio devices this can be a difficult problem, because the length of the antenna must be quite long for the more common transmission frequencies. For example, a traditional center fed half wavelength dipole antenna having a resonant frequency of 937.5 MegaHertz typically is approximately 16 centimeters (cm) in length. A comparable quarter-wave monopole antenna that extends above a conducting plane is 8 cm in length for nearly the same resonant frequency. In smaller portable radio devices, there is typically no space for an antenna 8 to 16 cm in length.

In order to afford an antenna which may be fitted within smaller portable devices, it thus becomes desirable to operate the antenna at a wavelength greater than eight times the dipole length. Shortening the length of dipole or monopole antennas in such manner, however, impedes its ability to exhibit the desirable series-resonant effect, especially at high operating frequencies. In theory, the shortening of an arm length of a dipole or monopole antenna reduces the inductive reactance of the antenna which in turn causes its overall reactance to become more and more capacitive. It is well known that series resonance is accomplished by designing an antenna such that a balance exists between inductive and capacitive reactance, thereby eliminating overall reactance. Since the shortening of the antenna decreases the inductive reactance, a higher capacitance must be incorporated in the antenna to reduce the capacitive reactance, thereby matching the reduced inductive reactance. In the case of short dipole or monopole antennas, the reduction of inductive reactance is severe, thus calling for a sizable increase in capacitance. This augmentation of capacitance of short dipole or monopole antennas is extremely difficult, if not impossible, in minimal volumetric spaces given present methods.

Therefore, a need exists for an antenna design which has the same electromagnetic field characteristics of a center-fed half wavelength dipole antenna, but which has a shorter length dimension. There also exists a need for a short dipole antenna that is capable of exhibiting series resonance at a frequency which corresponds to a wavelength much longer than the length of the antenna. This would allow an efficiently designed antenna to be hidden inside of the main part of a portable radio device rather than extending along the outside of the portable radio device into free space for some distance.

The present invention provides a solution to this and other problems, and offers other advantages over the prior art.

SUMMARY OF THE INVENTION

The present invention relates to antenna designs having a compact design with a shorter length than traditional half wave dipole antennas.

In one embodiment, an electric dipole antenna includes a first and a second arm extending along a dipole axis away from a feed gap in substantially opposite directions. A first and a second end body are operaconductively coupled to opposite ends of the first and the second arms. Each end body has a width dimension which extends perpendicular to the dipole axis. A dipole length dimension extends along the dipole axis through the first and the second arms and the first and the second end bodies. A current conduction circuit provides a radiation field for the electric dipole antenna. The circuit passes along the first and the second arms and around a closed perimeter enclosing a finite volume of the first and the second end bodies resulting in an electric dipole antenna which exhibits a series resonant frequency at a wavelength which is at least eight times the dipole length dimension.

In another embodiment in accordance with the present invention, an electric monopole antenna design is used. The monopole antenna is situated over a conducting ground plane which reflects the above-ground-plane portion of the antenna. With the reflected portion, the monopole antenna effectively forms a dipole antenna that has the same characteristics of the electric dipole design summarized above.

BRIEF DESCRIPTION OF THE DRAWINGS

Other aspects and advantages of the present invention will become apparent upon reading the following detailed description and upon reference to the drawings in which.

Figure 1:
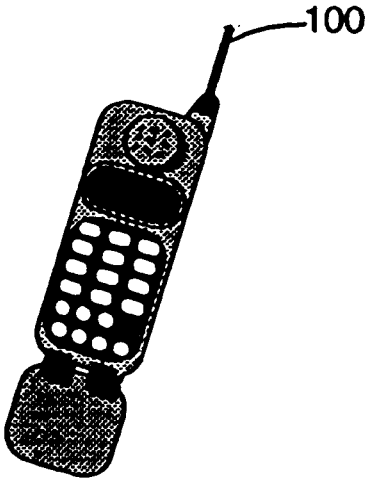
FIG. 1 is an illustration of a prior art portable radio device.

While the invention is susceptible to various modifications and alternative forms, specifics thereof have been shown by way of example in the drawings and will be described in detail. It should be understood, however, that the intention is not to limit the invention to the particular embodiment described. On the contrary, the invention is to cover all modifications, equivalents, and alternatives falling within the spirit and scope of the invention as defined by the appended claims.

DETAILED DESCRIPTION OF THE INVENTION

Referring now to FIG. 1, a prior art portable radio device is shown. The portable radio device includes a quarter-wave monopole antenna 100 over a small ground plane. The antenna 100 has, for example, a resonant frequency of approximately 937.5 MegaHertz. This antenna 100 needs to be approximately 8 centimeters (cm) in length in order to have such a resonant frequency. Portable radio device designers have been stymied in their efforts to shrink the size of the antenna because of this constraint on the antenna length.

Figure 2:
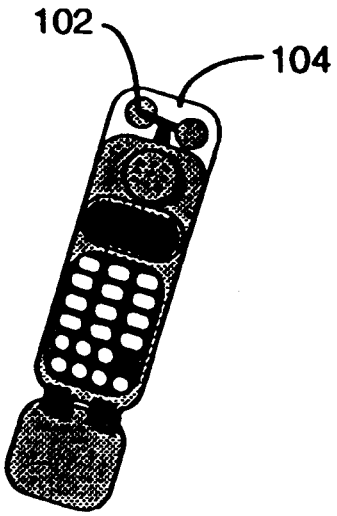
FIG. 2 is an illustration of a portable radio device including a volume-loaded short dipole antenna in accordance with the present invention.

FIG. 2 shows the same portable radio device as shown in FIG. 1, but with the device of FIG. 2 being configured with a volume-loaded short dipole antenna 102 in accordance with the present invention. This dipole antenna 102 has the same electromagnetic field characteristics as the traditional monopole antenna 100 shown in FIG. 1, but has a length dimension which is about three times shorter. The particular design constraints and operating parameters of this dipole antenna 102 will be described below in reference to FIGS. 3–6.

The use of this dipole antenna 102 allows the portable radio device designer to encase the antenna 102 inside a cavity 104 within the portable radio device. Also, it should be noted that the height and width dimensions of the dipole antenna 102 are much less than those of traditional monopole antenna 100.

Figure 3:
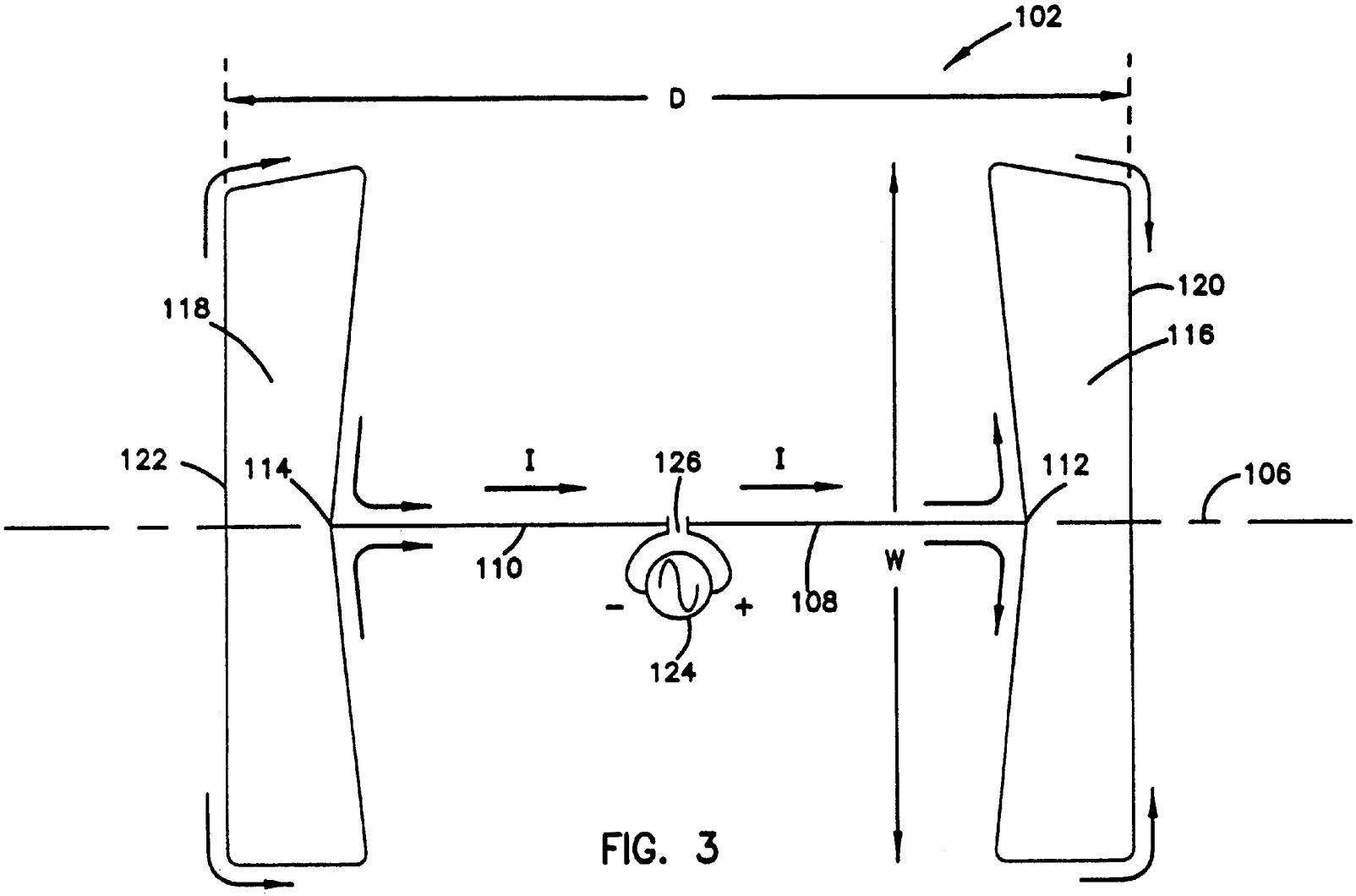
FIG. 3 is an illustration of a schematic drawing of the volume-loaded short dipole antenna depicted in FIG. 2 in accordance with the present invention.

A schematic diagram of the volume-loaded short dipole antenna 102 is shown in FIG. 3. The schematic diagram can be viewed as either a metal wire construction or a profile for a metal structure which is a figure of revolution around the dipole antenna axis 106. While these implementations are acceptable, other body shapes functioning in a similar manner provide the same antenna behavior.

The short electric dipole antenna 102 includes first and second arms 108 and 110 extending along a dipole axis 106 away from a feed gap 126 in substantially opposite directions and terminating in arm ends 112 and 114, respectively. A first 120 and a second 122 end body is operatively coupled to respective ends 112, 114 of the first 108 and the second 110 arm. Each end body 120 or 122 has a width dimension measured perpendicular to the dipole axis 106. A dipole length dimension extends along the dipole axis 106 through the first 108 and the second 110 arms and the first 120 and the second 122 end bodies.

A current conduction circuit provides a radiation field for the electric dipole antenna 102. The circuit passes along the first 108 and the second 110 arms and around a closed perimeter of the first 120 and the second 122 end bodies. The electric dipole antenna which has this current conduction circuit exhibits a series resonant frequency at a wavelength which is at least eight times the dipole length dimension.

In transmitter mode, current is driven along the arms 108 and 110 of the dipole antenna 102, as indicated by the arrows. When the current reaches the arm end 112 or 114 of the arm 108 or 110, it spreads out and travels in a symmetrical fashion around the space 116 or 118 enclosed by the end body 120 or 122. This dipole antenna 102 is "volume-loaded" via the large end bodies. As a result of this volume loading, the charge build-up (either positive or negative) is along an entire outer rim of the end bodies 120 and 122. This charge is farthest away from the associated arm. By maximizing the charge build up area with the use of volumetric end bodies, the capacitive reactance of the volume-loaded dipole antenna 102 is sufficiently reduced so as to allow series resonance to occur. If the width dimension "W" of the bodies 120 and 122 is comparable to the overall length dimension "D" of the dipole antenna 102, then the terminal impedance of the antenna will exhibit a series resonance at a frequency such that "D" equals the wavelength/eight or smaller. The particular ratio of dipole length to wavelength of the resonant frequency is dependent on body shape and arm wire diameter.

One advantage of the dipole antenna design is that the size reduction will allow the antenna to be hidden in the radio package for many applications as described above. In addition, the relatively low resonance resistance of the dipole antenna 102 (which results from the effective capacitance reduction) is closer to the desired load impedance for power transistors designed to work above a 30-MegaHertz frequency.

Another advantage is that the volume-loaded dipole antenna 102 is usable at its resonant frequency in the same way as a standard unloaded dipole antenna 100 of much greater length. For many kinds of radio service, a single simple matching network can be coupled to the antenna 102 so that it will optimally receive (i.e., cover) a desired frequency bandwidth which is centered on the resonant frequency of the antenna.

Some end body shapes give Q (i.e., the radio of reactance over resistance) values substantially below those obtainable using prior art electrically small antennas over a broad frequency bandwidth. For example, volume-loaded dipole antennas which use cylindrical end bodies operate effectively from 0.7 to 1.3 times the resonant frequency of the antenna. It should be noted that the low-frequency end is usually a problem for typically implemented small antennas, since high antenna Q means narrow operating bandwidth. With either an elaborate fixed network or a network using variable elements, the volume-loaded small dipole antenna can operate effectively in frequency bandwidths below 0.6 to over 2 times the resonant frequency of the antenna.

First and second end bodies 120 and 122 each have a body profile within a plane parallel to and extending through the dipole axis 106. Each body profile may take many different shapes; however, each body profile preferably is a closed figure such as a rectangle, an ellipse, a polygon, a concave polygon, a trapezoid, a double triangle, a double trapezoid, or a parallelogram in which lines defining the body profile do not cross (crossed lines can cause current leakage which destroys the effect of volume loading). In antenna 102, each body profile is symmetrical about the dipole axis 106 such that current flows evenly around the closed perimeter of the body profile in opposite directions from the end 112 of 114 of the arm 108 or 110. In an alternative embodiment, each body profile is asymmetrical about the dipole axis 106 such that at least some current flows around the closed body perimeter profile in opposite directions from the arm end 112 or 114. The asymmetrical body profile is less ideal than the symmetrical one, because the electromagnetic field radiation pattern is not as strong overall as the pattern surrounding the symmetrical one. However, in some environments a particular irregular-shaped radiation pattern may be preferred and a precisely shaped asymmetrical body profile can be matched to this desired radiation pattern.

Further, the shape of the first and the second end bodies 120 and 122 is also described by a body cross-section within a plane perpendicular to the dipole axis 106. This body cross-section is preferably a closed figure such as a square, an ellipse, a circle, an open-interior clover-leaf pattern, a regular polygon, or an irregular polygon in which lines defining an outline of each closed figure do not cross. An acceptable shape, from a performance vantage point, has a convex regular shape that is centered on the dipole axis 106 and which is designed to fit the space available. Such a shape encloses the largest amount of space 116 or 118. An irregular cross-section or profile, with an off-center connection to the dipole arm end, can also exhibit a series-resonant effect at a wavelength greater than eight times the dipole length by virtue of the basic principle of current flow given above.

The first and second arms 108 and 110 can be implemented from a variety of arm shapes, including: a wire, a rod, a tube, a cone, and a rod of smoothly changing curvature so long as the arms conduct an electric charge to and from the feed gap 126. For example, the arms could consist of a sequentially joined combination of the arm shapes along the dipole axis 106 (e.g., a rod attached to a cone which is attached to an end body). Also, for example, the arms could consist of a flat strip (e.g., a strip line on a semiconductor wafer) which approximates one of the arm shapes. In addition, for example, the arms could consist of a group of wires which approximates one of the arm shapes.

The first and second end bodies 120 and 122 each can consist of a solid body which is a figure of rotation centered around the dipole axis 106 as shown in FIG. 2.

Figure 5:
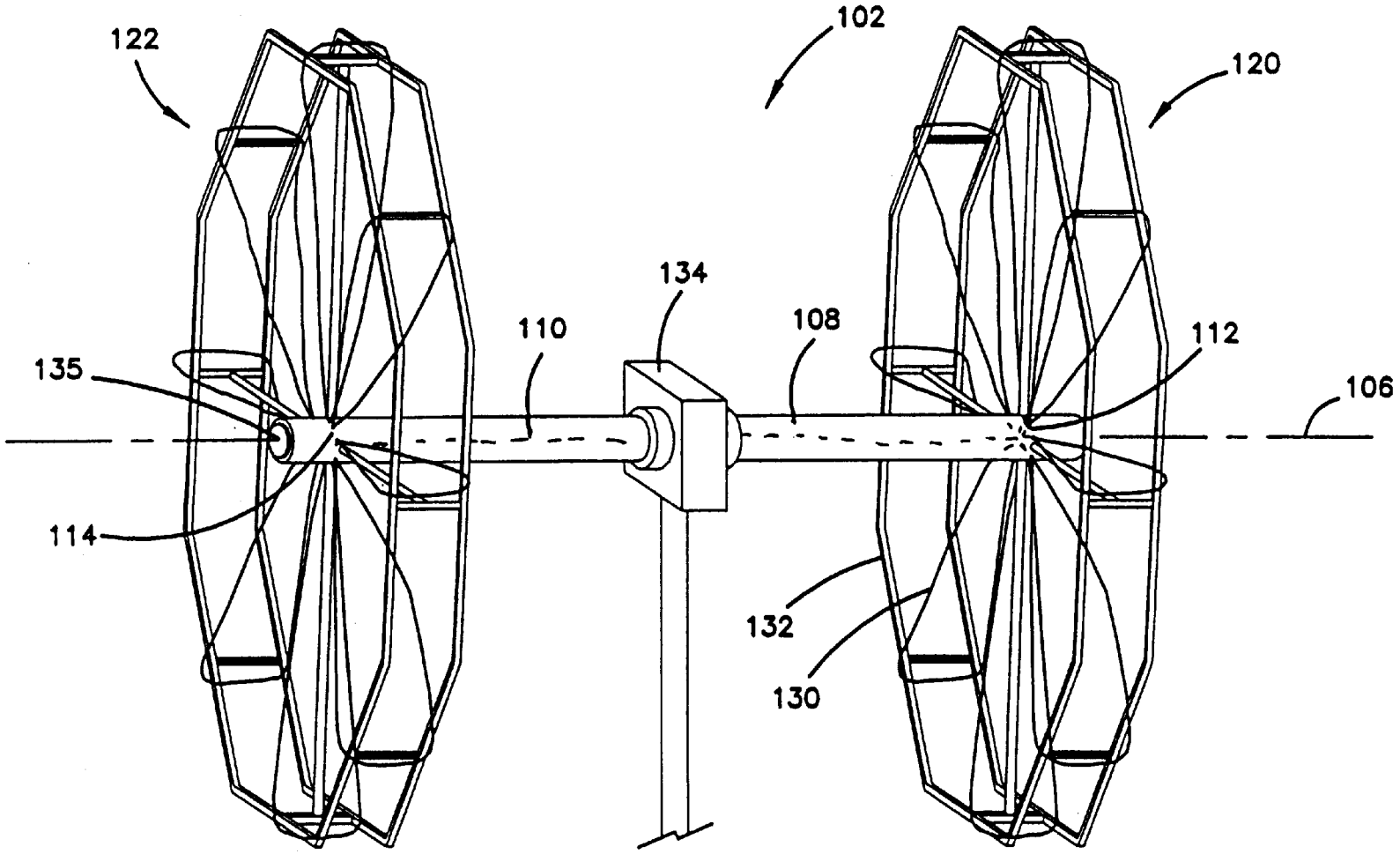
FIG. 5 is an illustration of a wire frame approximation in accordance with the present invention for an embodiment having a solid surface end body different from the volume-loaded short dipole antenna depicted in FIG. 4.

The first and second end bodies 120 and 122 may each consist of a wire 130 on a frame 132 approximation, like the one shown in FIG. 5, for a solid body that is a figure of rotation substantially centered around the dipole axis 106. Such a wire frame approximation will have nearly the same operating characteristics as a solid body provided that the wires are close enough together.

Figure 4:
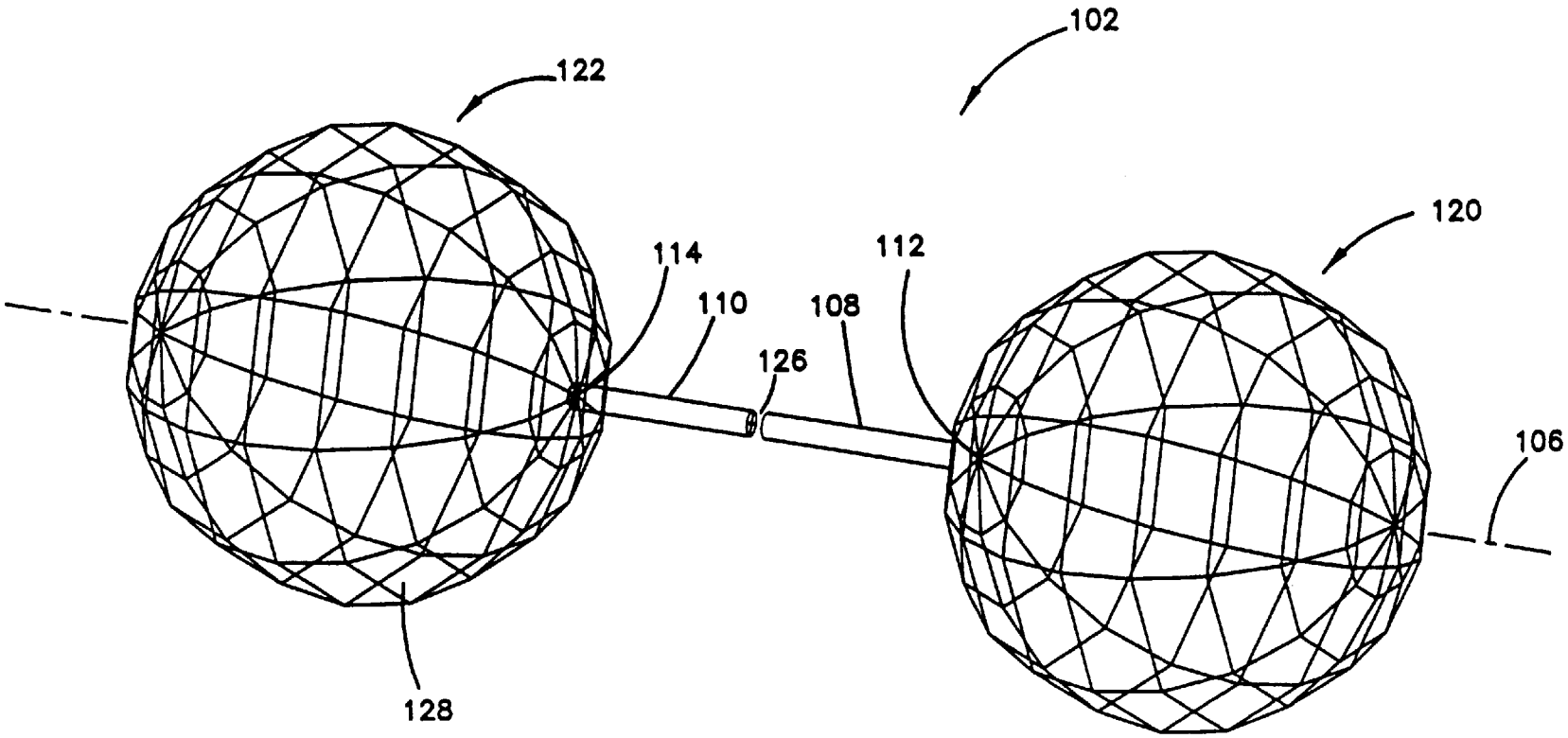
FIG. 4 is an illustration of a wire segmented approximation in accordance with the present invention for the solid surface and body volume-loaded short dipole antenna depicted in FIG. 2.

Similarly, the first and second end bodies 120 and 122 may each consist of a segmented approximation for a solid body which is a figure of rotation centered around the dipole axis 106, as shown in FIG. 4 with segment plates 128.

Many different volume-loaded dipole antenna designs may be developed without departing from the scope and spirit of the present invention. Such antennas in other frequency bands have the same characteristics of the antennas described herein provided that appropriate scaling of the dimensions of the antenna is accomplished.

For example, a wire frame approximation of a volume-loaded dipole antenna 102 is shown in FIG. 5. This particular antenna has end bodies with a cross section having an octagon shape. The antenna has been optimized for use in the high frequency (HF) band. This particular frequency band is of some interest, because it is the only natural world-wide communication channel.

Since the wire 130 is not self-supporting, a frame 132 made out of some non-conducting/high impedance material (e.g., a plastic pipe) can be built to support the wire 130. In this example, the dipole arms 108 and 110 are horizontal, inside plastic pipes, and the wire 130 hoops preferably are suspended from the octagonal frames. The octagonal frames are supported by pipes from the large or W-wire-enclosing pipes. Each of the wire 130 hoops is connected together near the arm ends 112 and 114. The arm pipes are about 1 meter (m) long from the outside of the terminal box 134 (which houses the feed gap 126) to the end cap 135. Each pair of wire hoops preferably is spaced about 20 centimeters (cm) apart. A figure of revolution, having two end bodies 120 and 122, with a profile of 2 m, with a wire going from the center out 0.94 m to the arm ends 112 and 114 in each direction has been found to have a resonant frequency of 15 MegaHertz (Mhz).

The embodiment of FIG. 5 has been shown to be successful without needing a solid surface. For example, in a 2-meter body cube having 8 full wire 130 loops at each, or a total of 32 wires 130, a good approximation of the operation characteristics for a solid surface end body was achieved. A series resonant frequency occurs when one complete wire 130 loop is placed on the frame 132 and this resonant frequency decreases toward the solid surface end body resonant frequency as more wire 130 loops are added. With 32 wires 130, a resonant frequency just over 12 Mhz can be achieved on this example HF antenna. This 2-meter cube achieves the same resonant frequency that a standard 12.5-meter-long dipole achieves (i.e., the length dimension of this embodiment is roughly $1/12^{th}$ of the wavelength).

In an alternative embodiment, an antenna array consisting of a plurality of volume-loaded electric dipole antennas can be connected together. Each electric dipole antenna is configured with a particular amplitude and phase relationship to the other of each electric dipole antennas in the array to form a particular antenna radiation pattern. This antenna array radiation pattern will cover a wider frequency band and/or different frequency band than the one covered by each individual antenna in the array. The design configuration of such an array from typical dipole elements is well known in the art and as such is not repeated herein. The principles of forming an array are the same for volume-loaded dipole antennas.

Figure 6:
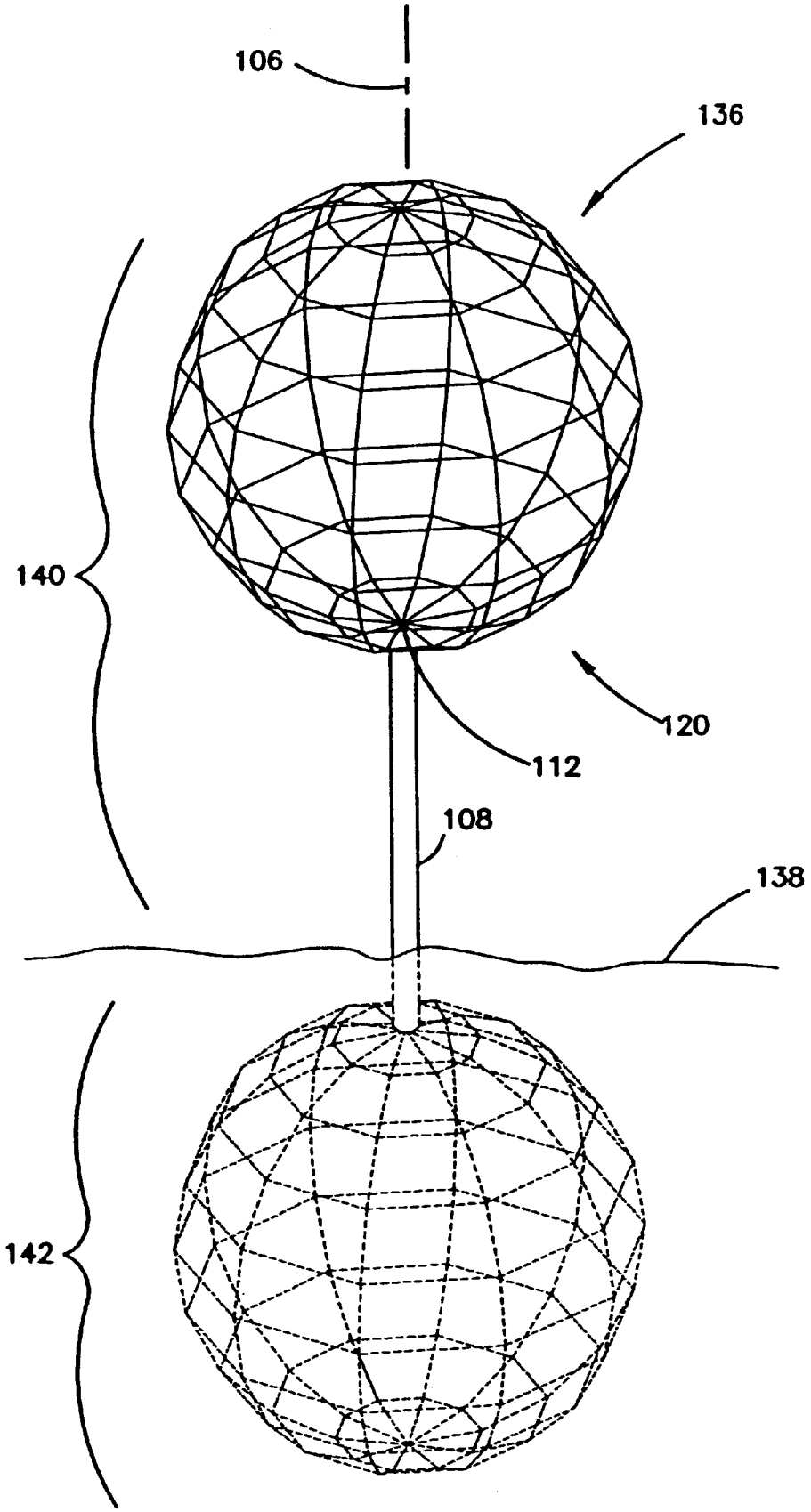
FIG. 6 is an illustration of an alternative embodiment of a volume-loaded short monopole antenna in accordance with the present invention.

An alternative embodiment electric monopole antenna design 136, as shown in FIG. 6 can be utilized in many radio devices. This monopole antenna 136 operates over a conducting ground plane 138 which reflects the above-ground plane portion 140 of an electric monopole antenna 136 to an imaginary portion 142 below the ground plane 138. With the reflected portion, the monopole antenna effectively forms a dipole antenna that has the same characteristics of the electric dipole design 102 described above. This alternative embodiment volume-loaded monopole antenna 136, like the volume-loaded dipole antenna 102, has a significantly smaller length dimension than a comparable standard monopole antenna. A standard monopole antenna is at least 8 times longer than the inventive antenna 136. When compared to a standard monopole antenna, volume-loaded monopole antenna designs having some shapes operating in some frequency bandwidths can exhibit a series resonant frequency at a wavelength which is between twenty and thirty times the monopole length dimension. For example, a monopole antenna having an arm made of a wire 0.254 millimeters (mm) in diameter and 13.3 mm long, as well as an end body shaped as a cylinder 3.3 mm long and 35 mm in diameter, will exhibit series resonance at about 915 MegaHertz.

Although numerous characteristics and advantages of various embodiments of the present invention have been set forth in the foregoing description, together with details of the structure and function of various embodiments of the invention, this disclosure is illustrative only, and changes may be made in detail, especially in matters of shape, size and arrangement of parts within the principles of the present invention to the full extent indicated by the broad general meaning of the terms in which the appended claims are expressed.

I claim:

1. A short electric dipole antenna for communicating at a desired carrier frequency, comprising:

a first and second arm extending along a dipole axis away from a feed gap in substantially opposite directions;

a first and second end body, conductively connected to opposite ends of the first and second arm, respectively, at the respective ends of the first and second arms, each end body having a body width dimension extending perpendicular to the dipole axis and a body length dimension extending along the dipole axis, each of the end bodies having a respective charge build-up area located around a rim of the body a furthest distance from the dipole axis;

said first and second end bodies being 3-dimensional, completely enclosed volumetric bodies in which each has a body profile within a plane extending through the dipole axis, wherein the 3-dimensional, completely enclosed volumetric bodies each further has a body profile within a plane perpendicular to the dipole axis;

a current conduction circuit providing a radiation field for the electric dipole antenna, the circuit passing along the first and second arms and around a closed perimeter of the first and second end bodies, the arms and the end bodies being constructed and arranged such that the electric dipole antenna exhibits a series resonance at the desired carrier frequency corresponding to a wavelength which is at least eight times a dipole length dimension extending along the dipole axis through the bodies and the arms;

the electric dipole antenna operating in a transmitting mode by carrying current along the first and second arms and spreading around the first and second end bodies, the current developing a charge on the charge build-up area of each end body for exhibiting a maximum capacitive property which compensates for an inductive property exhibited by the arms, thereby affording the series resonance in a minimal volumetric space.

2. The electric dipole antenna as set forth in claim 1 wherein at least one of the bodies is cylindrical in shape.

3. The short electric dipole antenna as set forth in claim 1 wherein at least one of the bodies is rectangular in shape.

4. The short electric dipole antenna as set forth in claim 1 wherein the body profile of at least one of the bodies is selected from the group of closed figures consisting of a double triangle, a double trapezoid, an ellipse, a polygon, a concave polygon, and a trapezoid in which lines defining the body profile do not cross.

5. The short electric dipole antenna as set forth in claim 1 wherein the body profile of at least one of the bodies is asymmetrical about the dipole axis such that at least some current flows around the closed perimeter of the body profile in opposite directions from respective ends of the first and second arm.

6. The short electric dipole antenna as set forth in claim 1 wherein the body cross-section of at least one of the bodies is selected from the group of closed figures consisting of a square, an ellipse, a circle, an open-interior clover-leaf pattern, a regular polygon, and an irregular polygon in which lines defining an outline of each closed figure do not cross.

7. The short electric dipole antenna as set forth in claim 1 wherein at least one of the end bodies includes a hollow conducting shell enclosing a non-conducting structure.

8. The short electric dipole antenna as set forth in claim 1 wherein the antenna is situated within a portable, hand-held communication unit.

9. The short electric dipole antenna as set forth in claim 1 wherein the end bodies have different profiles.

10. The short electric dipole antenna as set forth in claim 1 wherein the end bodies have different cross-sections.

11. An electric monopole antenna for communicating at a desired carrier frequency and for use over a conducting ground plane which reflects the above-ground plane portion of an electric monopole antenna to effectively form a dipole antenna, the monopole antenna comprising:

an arm extending along a monopole axis away from a feed gap formed at the conducting ground plane;

a body, conductively connected to an end of the arm, having a body width dimension extending perpendicular to the monopole axis and a body length dimension extending along the monopole axis, the body having a charge build-up area located around a rim of the body a furthest distance from the monopole axis;

said body being a 3-dimensional, completely enclosed volumetric body which has a body profile within a plane extending through the monopole axis, wherein the 3-dimensional, completely enclosed volumetric body has a body profile within a plane perpendicular to the monopole axis; and a current conduction circuit providing a radiation field for the antenna, the circuit passing along the arm and around a closed perimeter of the end body, the arm and the body being constructed and arranged such that the electric monopole antenna exhibits a series resonance at the desired carrier frequency corresponding to a wavelength which is at least eight times a monopole length dimension extending along the monopole axis through the body and the arm;

the electric monopole antenna operating in a transmitting mode by carrying current along the arm and spreading around the end body, the current developing a charge on the charge build-up area of the end body for exhibiting a maximum capacitive property which compensates for an inductive property exhibited by the arm, thereby affording the series resonance in a minimal volumetric space.

12. The short electric monopole antenna as set forth in claim 11 wherein the body is cylindrical in shape.

13. The short electric monopole antenna as set forth in claim 11 wherein the body is rectangular in shape.

14. The short electric monopole antenna as set forth in claim 11 wherein the body profile is selected from the group of closed figures consisting of a double triangle, a double trapezoid, an ellipse, a polygon, a concave polygon, and a trapezoid in which lines defining the body profile do not cross.

15. The short electric monopole antenna as set forth in claim 11 wherein the body profile is asymmetrical about the monopole axis such that at least some current flows around the closed perimeter of the body profile in opposite directions from the end of the arm.

16. The short electric monopole antenna as set forth in claim 11 wherein the body cross-section is selected from the group of closed figures consisting of a square, an ellipse, a circle, an open-interior clover-leaf pattern, a regular polygon, and an irregular polygon in which lines defining an outline of each closed figure do not cross.

17. The short electric monopole antenna as set forth in claim 11 wherein the arm is a wire 0.254 mm in diameter and 13.3 mm long and the end body is a cylinder 3.3 mm long and 35 mm diameter such that the monopole antenna exhibits series resonance at about 915 MegaHertz.

18. The short electric monopole antenna as set forth in claim 11 wherein the end body includes a hollow conducting shell enclosing a non-conducting structure.

19. The short electric monopole antenna as set forth in claim 11 wherein the antenna is situated within a portable, hand-held communication unit.

* * * * *